US009593555B2

(12) United States Patent
Vick, Jr.

(10) Patent No.: US 9,593,555 B2
(45) Date of Patent: Mar. 14, 2017

(54) AUTO-FILLING OF A TUBULAR STRING IN A SUBTERRANEAN WELL

(75) Inventor: James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 209 days.

(21) Appl. No.: 14/387,988

(22) PCT Filed: May 30, 2012

(86) PCT No.: PCT/US2012/040004

§ 371 (c)(1),
(2), (4) Date: Sep. 25, 2014

(87) PCT Pub. No.: WO2013/180706

PCT Pub. Date: Dec. 5, 2013

(65) Prior Publication Data

US 2015/0083428 A1 Mar. 26, 2015

(51) Int. Cl.
*E21B 34/08* (2006.01)
*E21B 34/06* (2006.01)
(Continued)

(52) U.S. Cl.
CPC ..... *E21B 34/16* (2013.01); *E21B 21/103* (2013.01); *E21B 34/08* (2013.01); *E21B 34/12* (2013.01);
(Continued)

(58) Field of Classification Search
CPC .. E21B 2034/007; E21B 21/103; E21B 34/08; E21B 34/12; E21B 34/14; E21B 34/16; F16K 1/14; F16K 17/36
See application file for complete search history.

(56) References Cited

U.S. PATENT DOCUMENTS 4,108,203 A 8/1978 Brown
4,258,801 A 3/1981 Poston
(Continued)

FOREIGN PATENT DOCUMENTS

GB 2048996 A 12/1980
GB 2399361 A 9/2004
(Continued)

OTHER PUBLICATIONS

Extended European Search Report Application No./Patent. No. 12877620.0-1610 / 2831369 PCT/US2012040004 dated Jan. 27, 2016.
(Continued)

*Primary Examiner* — Blake Michener
*Assistant Examiner* — Christopher Sebesta
(74) *Attorney, Agent, or Firm* — Locke Lord LLP; Peter Fallon; Joshua L. Jones

(57) ABSTRACT

A system can include at least one check valve which prevents outward flow through a wall of a tubular string in a well, the wall surrounding a longitudinally extending flow passage of the tubular string. The check valve can include a ball or poppet which sealingly engages a seat. Another system can include multiple redundant check valves which prevent outward flow through a wall of a tubular string in a well. A well tool can include multiple redundant check valves which prevent flow in one direction through the wall, and which permit flow in an opposite direction through the wall. Each of the multiple redundant check valves can include a ball or poppet which sealingly engages a seat.

20 Claims, 3 Drawing Sheets

(51) Int. Cl.

| | |
|---|---|
| ***E21B 34/16*** | (2006.01) |
| ***E21B 34/12*** | (2006.01) |
| ***E21B 21/10*** | (2006.01) |
| ***E21B 34/14*** | (2006.01) |
| *E21B 34/00* | (2006.01) |

(52) U.S. Cl.
CPC ..... *E21B 34/14* (2013.01); *E21B 2034/007* (2013.01)

(56) References Cited

U.S. PATENT DOCUMENTS

| | | | | |
|---|---|---|---|---|
| 4,392,507 | A * | 7/1983 | Harris | B60K 15/03519 137/38 |
| 6,059,038 | A | 5/2000 | Vick, Jr. | |
| 6,116,336 | A | 9/2000 | Adkins et al. | |
| 2002/0189814 | A1* | 12/2002 | Freiheit | E21B 34/102 166/373 |
| 2004/0040718 | A1 | 3/2004 | Rhodes et al. | |
| 2006/0124310 | A1* | 6/2006 | Lopez de Cardenas | E21B 34/06 166/313 |
| 2009/0151925 | A1* | 6/2009 | Richards | E21B 34/06 166/53 |
| 2010/0170571 | A1* | 7/2010 | Anderson | F16K 15/042 137/1 |
| 2011/0284232 | A1* | 11/2011 | Huang | E21B 21/103 166/317 |

FOREIGN PATENT DOCUMENTS

| | | | |
|---|---|---|---|
| WO | WO-02061236 | A1 | 8/2002 |
| WO | WO-02068793 | A1 | 9/2002 |

OTHER PUBLICATIONS

International Search Report with Written Opinion issued Feb. 1, 2013 for PCT Patent Application No. PCT/US12/040004, 11 pages.
Halliburton Drawing No. 21FS38800, titled "Autofill Sub Assembly", dated May 18, 2009, 1 page.

* cited by examiner

AUTO-FILLING OF A TUBULAR STRING IN A SUBTERRANEAN WELL

CROSS-REFERENCE TO RELATED APPLICATION

This application is a national stage under 35 USC 371 of International Application No. PCT/US12/40004, filed on 30 May 2012. The entire disclosure of this prior application is incorporated herein by this reference.

TECHNICAL FIELD

This disclosure relates generally to equipment utilized and operations performed in conjunction with a subterranean well and, in one example described below, more particularly provides for auto-filling a tubular string while it is being conveyed into a well.

BACKGROUND

When a tubular string is being conveyed into a well, it is typically desirable to allow the tubular string to fill with fluid in the well, so that it is not necessary to separately fill the tubular string. However, it is also desirable at times to be able to pressurize the interior of the tubular string, for example, to hydraulically set a packer, fire a perforating gun, etc. Typically, it is then desired to prevent further flow into the tubular string, for example, until production is initiated.

Therefore, it will be appreciated that there is a continual need to develop improved systems and methods which allow a tubular string to be "automatically" filled while it is being conveyed into a well, but which also allow the tubular string to be internally pressurized.

SUMMARY

In this disclosure, a well tool is provided which brings improvements to the art of tubular string design. One example is described below in which the well tool includes multiple redundant check valves. Another example is described below in which the well tool uses a ball and seat-type check valve to prevent outward flow through a wall of a tubular string (e.g., to allow pressurizing the tubular string), but to permit inward flow through the wall (e.g., to allow the tubular string to fill as it is being conveyed into a well).

A system for use with a subterranean well is described below. In one example, the system can include at least one check valve which prevents outward flow through a wall of a tubular string in the well, the wall surrounding a longitudinally extending flow passage of the tubular string. The check valve comprises a ball which sealingly engages a seat.

Another system for use with a subterranean well described below can include multiple redundant check valves which prevent outward flow through a wall of a tubular string in the well, the wall surrounding a longitudinally extending flow passage of the tubular string.

A well tool is also described below for interconnection in a tubular string for use in a subterranean well. In one example, the well tool can include multiple redundant check valves which prevent flow in a first direction through the wall, and which permit flow in a second direction opposite to the first direction through the wall. Each of the multiple redundant check valves comprises a ball which sealingly engages a seat.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
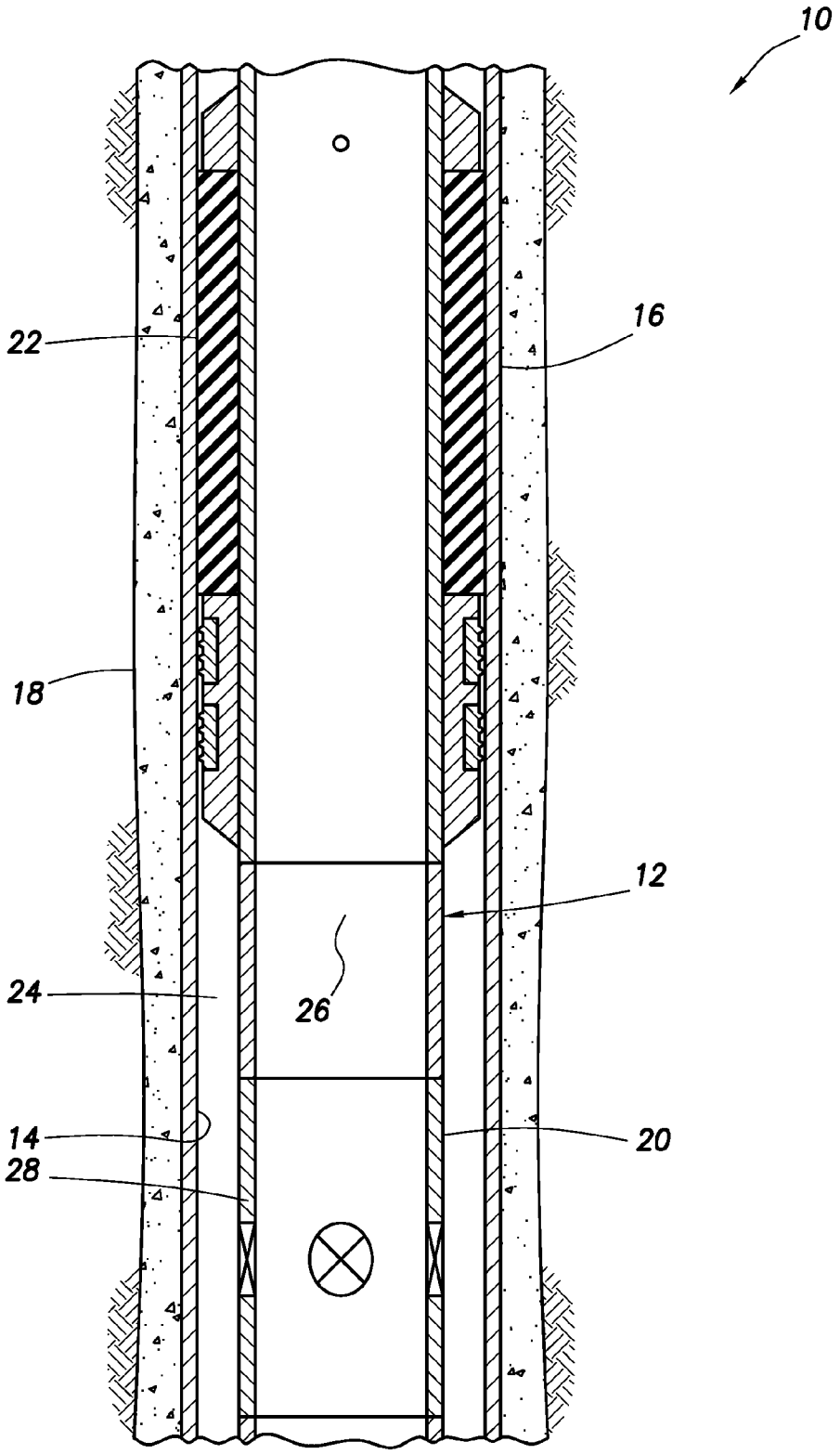
FIG. 1 is a representative partially cross-sectional view of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 has been conveyed into a wellbore 14 lined with casing 16 and cement 18. The tubular string 12 has interconnected therein a well tool 20 and a packer 22.

The packer 22 is an example of a type of well tool which can be actuated with pressure applied to an interior of the tubular string 12. Other examples include perforating gun firing heads, fracturing/gravel packing equipment, etc.

The well tool 20 allows the tubular string 12 to be filled with fluid (such as, fluid in an annulus 24 formed radially between the tubular string and the wellbore 14) as the tubular string is being conveyed into the wellbore, and also allows the tubular string to be internally pressurized, for example, to periodically pressure test the tubular string after a few joints have been added to the string. The internal pressure may then be used for hydraulically setting the packer 22 (e.g., to seal off the annulus 24), or for accomplishing any other objective (such as, actuating other types of well tools, etc.). When sufficient internal pressure is applied (e.g., to set the packer 22) the well tool 20 is closed, preventing further flow into the tubular string through the well tool.

In an example described more fully below, the well tool 20 includes at least one check valve that permits flow from the annulus 24 to an inner longitudinally extending flow passage 26 through a wall 28 which surrounds the passage. The check valve prevents flow from the passage 26 to the annulus 24 through the wall 28.

Figure 2:
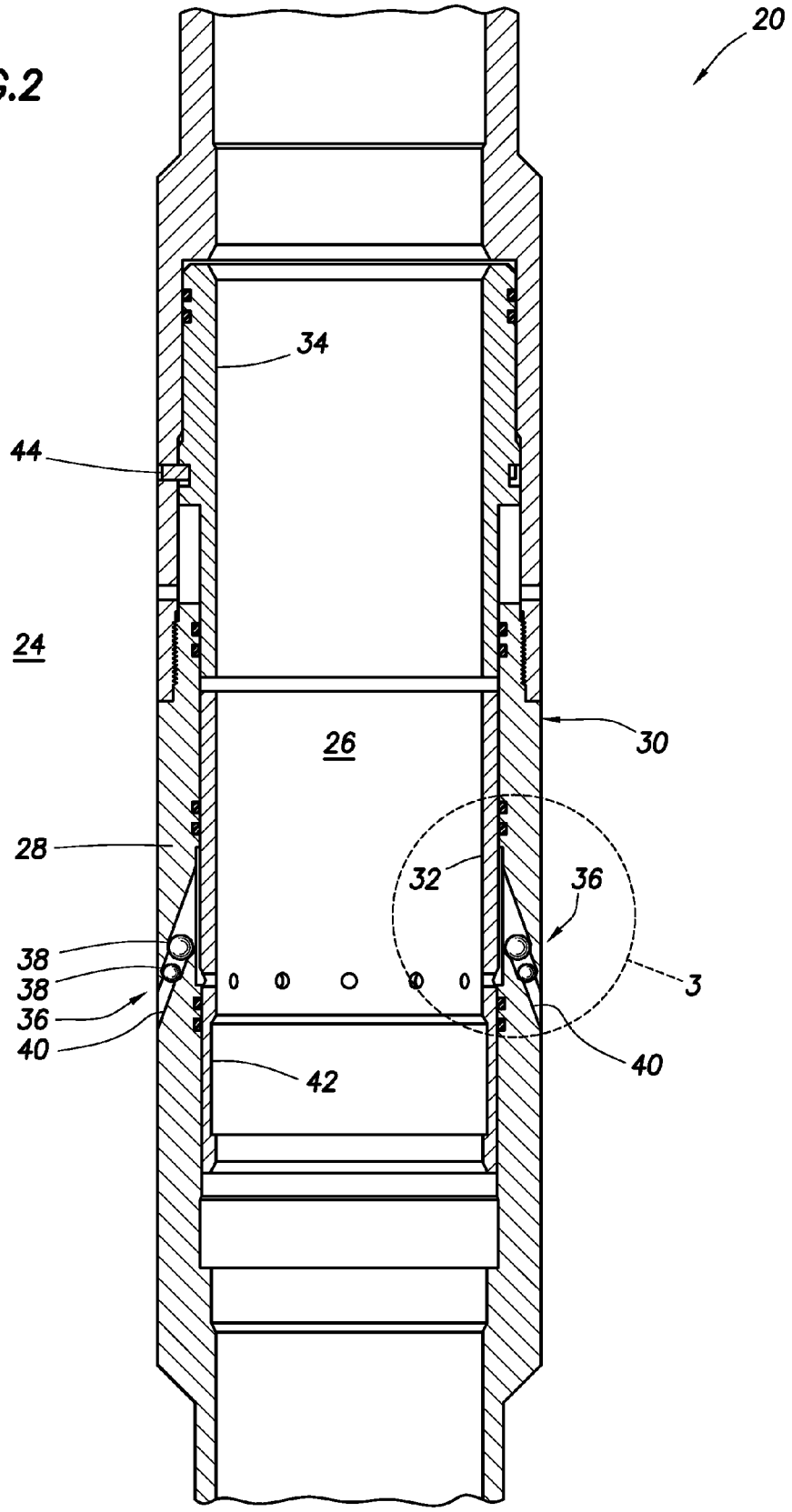
FIG. 2 is a representative enlarged scale cross-sectional view of a well tool which may be used in the system and method of FIG. 1.

Referring additionally now to FIG. 2, a more detailed cross-sectional view of one example of the well tool 20 is representatively illustrated. The well tool 20 may be used with the system 10, or it may be used with other systems or methods.

In the FIG. 2 example, the well tool 20 includes an outer generally tubular housing 30, an inner generally tubular sleeve 32, an annular piston 34, and sets 36 of multiple redundant check valves 38. The sleeve 32 is reciprocably displaceable between open and closed positions, in which flow through ports 40 is respectively permitted or prevented.

The ports 40 provide for fluid communication between the passage 26 and the annulus 24 exterior to the well tool 20. In FIG. 2, the sleeve 32 is in its open position, and flow through the ports 40 is not blocked by the sleeve. If the sleeve 32 is displaced downward (as viewed in FIG. 2), however, the sleeve will block flow through the ports 40.

The sleeve 32 can be displaced downward to its closed position by engaging a conventional shifting tool (not shown) with an internal profile 42 in the sleeve, or by increasing pressure in the passage 26 relative to pressure in the annulus 24, thereby increasingly biasing the piston 34 downward. After shearing a shear member 44 at a predetermined pressure differential across the piston 34, the piston contacts the sleeve 32 and displaces it downward to its closed position.

The check valves 38 can also prevent flow through the ports 40, but in only one direction. In the FIG. 2 example, the check valves 38 permit flow inward through the ports 40 (e.g., so that the tubular string 12 can fill with fluid as it is being conveyed into the wellbore 14), but the check valves prevent flow outward through the ports (e.g., so that pressure in the passage 26 can be increased relative to pressure in the annulus 24).

Figure 3:
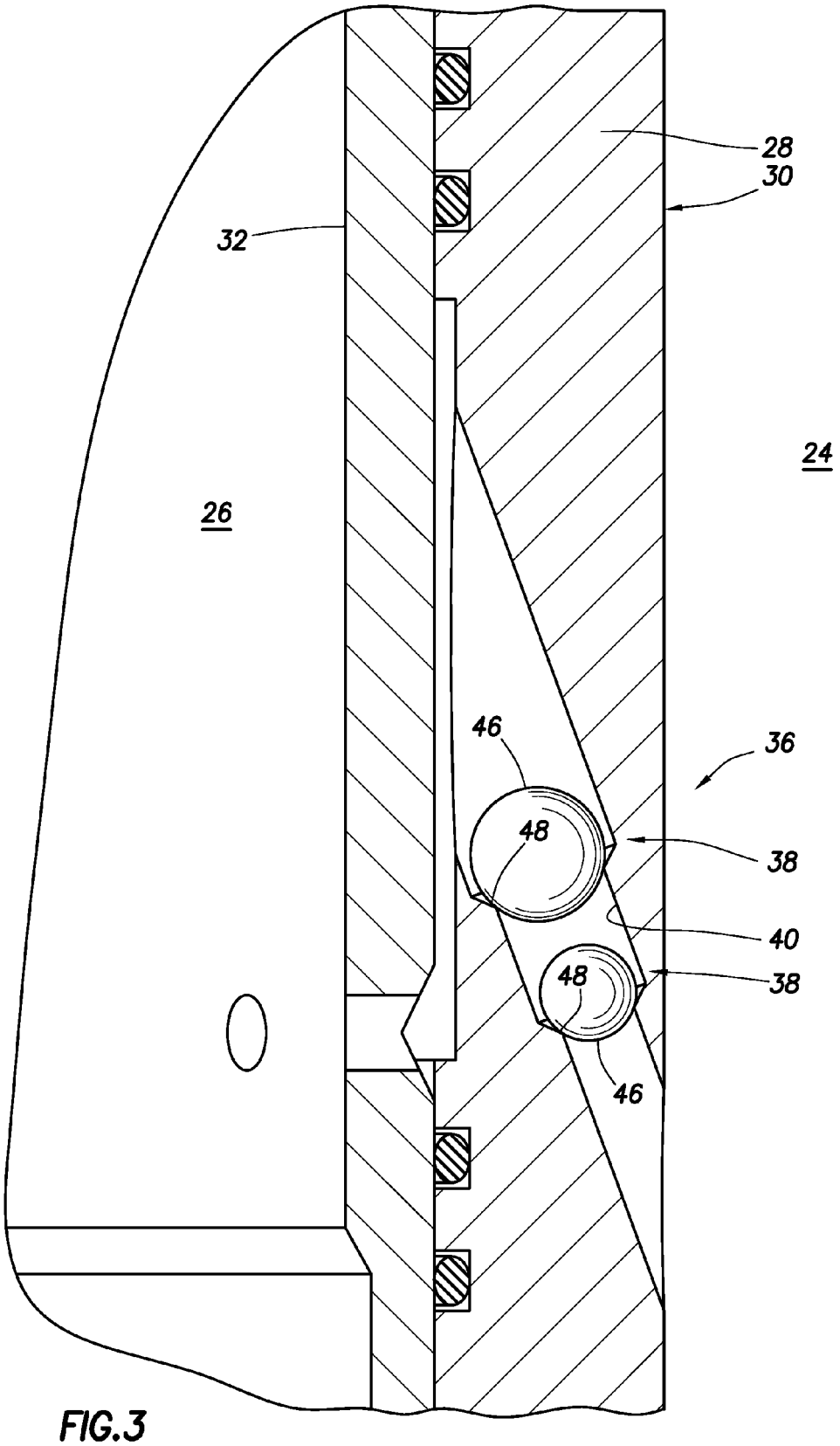
FIG. 3 is a representative further enlarged scale cross-sectional view of multiple redundant check valves in the well tool.

Referring additionally now to FIG. 3, an enlarged scale view of one example of a set 36 of the check valves 38 is representatively illustrated. The check valves 38 may be used in the well tool 20, or in any other well tool.

In the FIG. 3 example, each of the check valves 38 includes a poppet or ball 46 which sealingly engages a circular seat 48. Each of the seats 48 encircles the port 40. The seats 48 are formed directly in the wall 28, but in other examples separate seats could be used.

One advantage of using the poppet or ball and seat-type check valves 38 is that the poppet or ball 46 and/or seat 48 can be made of a hard, tough, erosion resistant, etc. material. Another advantage is that the components of the check valves 38 do not have to be flexible in order to permit flow through the port 40. However, other types of check valves (such as, flapper-type check valves, etc.) may be used for the check valves 38 in the well tool 20, if desired, and it is not necessary for the check valves to comprise hard, tough erosion resistant or rigid components.

One advantage of using multiple redundant check valves 38 is that, if one of the check valves does not function, another check valve can still provide for one-way flow through the port 40. In the FIG. 3 example, the check valves 38 are configured in series.

However, other configurations can be used in keeping with the scope of this disclosure. For example, it is not necessary for multiple redundant check valves 38 to be used, or for multiple check valves to be configured in series.

In the FIG. 3 example, the poppets or balls 46 have different diameters, and the seats 48 correspondingly have different diameters. The upstream (with respect to flow inward through the wall 28) check valve 38 has a smaller ball 46 diameter and seat 48 diameter, as compared to the downstream check valve ball and seat diameters. However, in other examples, the upstream check valve 38 could have larger or the same ball 46 and seat 48 diameters as compared to the downstream check valve ball and seat diameters.

Although the check valves 38 are depicted in the drawings as including spherical balls 46 as closure members to sealingly engage the seats 48, it will be appreciated that other types of check valves and other types of closure members may be used. For example, the balls 46 could instead be in the form of poppets which are not necessarily spherical in form.

When the sleeve 32 has been shifted to its closed position, there are desirably three redundant barriers to flow from the passage 26 to the annulus 24. One pressure barrier is the sleeve 32 itself. Two additional pressure barriers are provided by the check valves 38. These redundant barriers are particularly useful when applying increased pressure to set the packer 22, and for longer term prevention of leaks from the passage 26 to the annulus 24.

It may now be fully appreciated that the above disclosure provides significant advancements to the art of tubular string design. One example is described above in which the well tool 20 includes multiple redundant check valves 38. Another example is described above in which the well tool 20 uses a ball or poppet and seat-type check valve 38 to prevent outward flow through a wall 28 of a tubular string 12 (e.g., to allow pressurizing the tubular string), but to permit inward flow through the wall (e.g., to allow the tubular string to fill as it is being conveyed into a well).

A system 10 for use with a subterranean well is described above. In one example, the system 10 can include at least one check valve 38 which prevents outward flow through a wall 28 of a tubular string 12 in the well. The wall 28 surrounds a longitudinally extending flow passage 26 of the tubular string 12. The check valve 38 comprises a poppet or ball 46 which sealingly engages a seat 48.

The seat 48 may encircle a port 40 which provides fluid communication between the flow passage 26 and an exterior of the tubular string 12.

The at least one check valve 38 can comprise multiple check valves 38. The multiple check valves 38 may be configured in series, and/or may prevent outward flow through a same port 40.

The multiple check valves 38 may comprise multiple poppets or balls 46 and/or multiple seats 48 having diameters different from each other.

Another system 10 for use with a subterranean well can comprise multiple redundant check valves 38 which prevent outward flow through a wall 28 of a tubular string 12 in the well, the wall 28 surrounding a longitudinally extending flow passage 26 of the tubular string 12.

A well tool 20 for interconnection in a tubular string 12 for use in a subterranean well, with the tubular string 12 including a longitudinally extending flow passage 26 and a wall 28 which surrounds the flow passage 26, is described above. In one example, the well tool 20 includes multiple redundant check valves 38 which prevent flow in one direction through the wall 28, and which permit flow in an opposite direction through the wall 28. Each of the multiple redundant check valves 38 may comprise a poppet or ball 46 which sealingly engages a seat 48.

In this example, the check valves 38 do not necessarily prevent flow outward through the wall 28. The check valves 38 could instead prevent flow inward through the wall 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising: multiple check valves which prevent outward flow through a wall of a tubular string in the well, the wall surrounding a longitudinally extending flow passage of the tubular string, and wherein each check valve comprises a ball or poppet which sealingly engages a respective seat, wherein the multiple check valves are configured in series, wherein the seats and balls or poppets are in a port through the wall, wherein the port through the wall is angled obliquely relative to the wall.

2. The system of claim 1, wherein each seat encircles a port which provides fluid communication between the flow passage and an exterior of the tubular string.

3. The system of claim 1, wherein the multiple check valves prevent outward flow through a same port.

4. The system of claim 3, further comprising a sleeve which is displaceable to a position wherein the sleeve blocks flow through the port.

5. The system of claim 1, wherein the multiple check valves comprise multiple poppets or balls having diameters different from each other.

6. The system of claim 1, wherein the multiple check valves comprise multiple seats having diameters different from each other.

7. A system for use with a subterranean well, the system comprising: multiple redundant check valves which prevent outward flow through a wall of a tubular string in the well, the wall surrounding a longitudinally extending flow passage of the tubular string, wherein the multiple redundant check valves are configured in series, wherein the check valves are in a port through the wall, and wherein the port through the wall is angled obliquely relative to the wall.

8. The system of claim 7, wherein the multiple redundant check valves prevent outward flow through a same port.

9. The system of claim 7, wherein the multiple redundant check valves comprise multiple balls having diameters different from each other.

10. The system of claim 7, wherein the multiple redundant check valves comprise multiple poppets having diameters different from each other.

11. The system of claim 7, wherein the multiple redundant check valves comprise multiple seats having diameters different from each other.

12. The system of claim 7, wherein each of the check valves comprises a ball or poppet which sealingly engages a respective seat.

13. The system of claim 12, wherein each seat encircles a port which provides fluid communication between the flow passage and an exterior of the tubular string.

14. The system of claim 13, further comprising a sleeve which is displaceable to a position wherein the sleeve blocks flow through the port.

15. A well tool for interconnection in a tubular string for use in a subterranean well, the tubular string including a longitudinally extending flow passage and a wall which surrounds the flow passage, the well tool comprising: multiple redundant check valves which prevent flow in a first direction through the wall, and which permit flow in a second direction opposite to the first direction through the wall, and wherein each of the multiple redundant check valves comprises a ball or poppet which sealingly engages a respective seat, wherein the multiple redundant check valves are configured in series, wherein the seats and balls or poppets are in a port through the wall, wherein the multiple redundant check valves prevent outward flow through the wall, and wherein the port through the wall is angled obliquely relative to the wall.

16. The well tool of claim 15, wherein each seat encircles a port which provides fluid communication between the flow passage and an exterior of the tubular string.

17. The well tool of claim 15, wherein the multiple redundant check valves prevent flow through a same port.

18. The well tool of claim 17, further comprising a sleeve which is displaceable to a position wherein the sleeve blocks flow through the port.

19. The well tool of claim 15, wherein the balls or poppets have diameters different from each other.

20. The well tool of claim 15, wherein the seats have diameters different from each other.

* * * * *